US005967959A

United States Patent [19]

Niemi et al.

[11] Patent Number: 5,967,959

[45] Date of Patent: Oct. 19, 1999

[54] PRESS ROLL WITH A CERAMIC COATING, METHOD FOR MANUFACTURING THE SAME AND COATING COMPOSITION

[75] Inventors: Kari Niemi, Tikkakoski; Juha Wahlroos, Palokka; Pentti Lehtonen, Jyväskylä , all of Finland

[73] Assignee: Valmet Corporation, Helsinki, Finland

[21] Appl. No.: 09/057,236

[22] Filed: Apr. 8, 1998

[30] Foreign Application Priority Data

Apr. 11, 1997 [FI] Finland ..... 971541

[51] Int. Cl.[6] ..... B23P 15/00

[52] U.S. Cl. ..... 492/54

[58] Field of Search ..... 492/56, 54, 49; 428/36.9

[56] References Cited

U.S. PATENT DOCUMENTS

| | | | |
|---|---|---|---|
| 4,402,888 | 9/1983 | Runck | 29/56 |
| 4,536,435 | 8/1985 | Utsumi et al. | 428/209 |
| 4,704,776 | 11/1987 | Watanabe et al. | 29/56 |
| 4,748,736 | 6/1988 | Miihkinen | 29/527.2 |
| 4,967,663 | 11/1990 | Metcalf | 101/348 |
| 4,991,501 | 2/1991 | Yokoyama et al. | 101/148 |
| 5,070,587 | 12/1991 | Nakahira et al. | 29/132 |
| 5,111,567 | 5/1992 | Leino et al. | 29/132 |
| 5,123,152 | 6/1992 | Tenkula et al. | 29/132 |
| 5,257,965 | 11/1993 | Fuchs et al. | 492/56 |
| 5,272,821 | 12/1993 | Orloff et al. | 34/110 |
| 5,609,961 | 3/1997 | Solovjeva et al. | 428/469 |
| 5,840,386 | 11/1998 | Hatch et al. | 428/36.9 |

FOREIGN PATENT DOCUMENTS

| | | |
|---|---|---|
| 0207921 | 1/1987 | European Pat. Off. . |
| 0369968 | 5/1990 | European Pat. Off. . |
| 0481321 | 4/1992 | European Pat. Off. . |
| 0657237 | 6/1995 | European Pat. Off. . |
| 89950 | 10/1986 | Finland . |
| 84506 | 8/1991 | Finland . |
| 87942 | 12/1991 | Finland . |
| 9113204 | 9/1991 | WIPO . |
| 9715719 | 5/1997 | WIPO . |

*Primary Examiner*—I Cuda
*Attorney, Agent, or Firm*—Steinberg & Raskin, P.C.

[57] ABSTRACT

A press roll for a paper or board machine, a method for manufacturing a roll for a paper or board machine and a coating composition for a roll which enable the roll to endure difficult corrosion conditions. An adhesion/corrosion-protection layer having a thickness of from about 150 $\mu$m to about 300 $\mu$m is applied onto the frame part of the roll by a high-velocity flame spraying technique. The adhesion/corrosion-protection layer contains a nickel-chromium alloy. A tight-ceramic layer having a thickness from about 50 $\mu$m to about 150 $\mu$m is applied onto the adhesion/corrosion-protection layer by a high-velocity flame spraying technique and includes from about 50% to about 100% of $Al_2O_3$ and optionally includes up to about 50% of $TiO_2$ and/or any amount of $Al_2TiO_5$. A porous ceramic layer is applied onto the tight ceramic layer. The tight-ceramic layer may include only $Al_2TiO_5$ instead of $Al_2O_3$, with or without $TiO_2$.

16 Claims, 1 Drawing Sheet

PRESS ROLL WITH A CERAMIC COATING, METHOD FOR MANUFACTURING THE SAME AND COATING COMPOSITION

FIELD OF THE INVENTION

The present invention relates to a press roll for a paper or board machine, in particular a center roll for such a machine, a method for manufacturing a press roll for a paper or board machine, and a composition of a coating for a roll for use in a paper or board machine which is subject to difficult corrosion conditions.

BACKGROUND OF THE INVENTION

In a press section of early paper and board machines, a roll was used which was commonly made of granite. In spite of the excellent surface properties of granite rolls, rolls having a ceramic coating have been gradually substituted for granite rolls. In prior art rolls with metal, metal-ceramic and ceramic coatings, however, corrosion of various degrees has occurred in particular in more severe conditions, which corrosion causes corroding of the roll, delamination of the coating, and wear of the roll so that it becomes unusable.

These types of rolls are coated by means of thermal spraying, in which case the coating unavoidably remains porous, and the roll face susceptible to corrosion. In view of corrosion, the process conditions in paper industry have become more and more severe because, for reasons of protecting the environment, process water is recirculated to an ever greater extent, and the rolls also must operate under ever more corroding conditions. For this reason, it is necessary to renew the coatings on rolls and/or to replace the rolls quite frequently which, of course, causes high expenses.

Attempts have been made to improve the resistance of rolls to corrosion by means of a variety of different methods.

In Finnish Patent Application No. 853544, a method for coating a roll is described in which a metallic core of a roll has been coated fully or partly with a metal, such as stainless steel, and in which the proportion of chromium is from about 9% to about 35%. It has been believed that the presence of chromium in the steel expressly increases the resistance of steel to corrosion.

In Finnish Patent No. 89,950, the metal core of a roll has been coated with molybdenum- and nickel-based metals, such as nickel-chromium alloys, nickel-chromium aluminum alloys, etc., in order to improve the resistance of the roll to corrosion. This intermediate layer is applied onto the roll by means of flame spraying or plasma spraying. The thickness of the intermediate layer is from about 100 $\mu$m to about 500 $\mu$m. Between this porous metal layer and the core of the roll, it is further possible, by means of flame spraying or plasma spraying, to apply a tight metal film that inhibits corrosion and that has a thickness of about from about 100 $\mu$m to about 500 $\mu$m. Metals suitable for this are nickel, aluminum alloy, copper, stainless steel, etc., and the particles that are used for the spray coating material are very small.

In Finnish Patent No. 86,566, a roll coating is described including a corrosion-protection layer on the roll core and which has a thickness of at least about 0.5 mm. The tightness of the corrosion-protection layer is higher than about 96% and, if necessary, the corrosion-protection layer may have been sealed by means of laser, induction, plasma, flame, or electron-jet melting, or it may also have been produced by means of thermal spraying. The corrosion-protection layer consists of stainless steel whose chromium content is from about 10% to about 29%, and it is placed between the core mantle of the roll and the ceramic outer layer.

In Finnish Patent No. 82,094, a coating for a Yankee cylinder in a paper machine is described, whose resistance to corrosion permits manufacture of special papers in acid solutions, in which the pH can be in the range from about 3 to about 5. The coating has been made of a mixture of a metal powder and a carbide or nitride.

In Finnish Patent No. 84,506, a press roll for a paper machine is described in which the roll core has been coated with an intermediate layer which consists of a composite compound made of a ceramic and a metal, so that the ratio of the components in the composite compound is different in different parts of the intermediate layer in the direction of the radius of the roll. The intermediate layer is then coated with a ceramic material over the intermediate layer.

In European Patent Application No. 0 657 237, coating of a roll with tungsten carbide and chromium carbide by means of thermal spraying is described. The function of this coating is also, among other things, to improve the resistance to wear of the carbide coatings on rolls.

In European Patent Application No. 0 481 321, a press roll is described in which an intermediate layer made of a molybdenum-based or nickel-based alloy has been applied onto the metal core, for example, by means of plasma spraying. A ceramic layer is applied onto this layer by means of the plasma spraying method, which ceramic layer consists of metal oxides or mixtures of same. The roll is then coated with an organic polymer to fill the pores in the porous ceramic coating.

In the prior art methods and in the coatings that are used currently on the rolls in a paper machine, particularly the center roll of a press section of a paper machine, a problem is the softness of the polymer coating or the porosity of the ceramic coating. As a result, the medium that produces corrosion of the roll frame, such as moisture and other corroding materials, can penetrate through the small pores through the coating to the roll frame. In this connection, corrosion arises, which deteriorates, among other things, the adhesion of a ceramic coating to the roll and promotes damage to the metal core of the roll. In particularly difficult corrosive environments, such as rolls that operate under highly acid or alkaline conditions, very rapid corroding has been noticed in spite of a metallic corrosion-protection layer that has been applied underneath a ceramic coating by means of plasma spraying or high-velocity flame spraying (HVOF) and whose thickness is from about 200 $\mu$m to about 300 $\mu$m. In such a case, the coating layer of the roll often falls apart partially, i.e., delamination takes place, and the roll is unusable.

OBJECTS AND SUMMARY OF THE INVENTION

Accordingly, it is an object of the present invention to provide new and improved press rolls with a ceramic coating which can withstand difficult corrosion conditions.

It is another object of the present invention to provide new and improved methods for manufacturing press rolls with a ceramic coating which can withstand difficult corrosion conditions.

It is yet another object of the present invention to provide new and improved coating compositions for press rolls which can withstand difficult corrosion conditions.

It is still another object of the present invention to provide novel press rolls with a ceramic coating, novel methods for manufacturing a press roll, and novel compositions of a coating for a press roll which avoid the drawbacks of the prior art discussed above.

In order to attain these objects and others, the press roll in accordance with the invention includes a frame part, an adhesion/corrosion-protection layer having a thickness from about 150 μm to about 300 μm arranged on the frame part, a tight-ceramic layer having a thickness from about 50 μm to about 150 μm arranged on the adhesion/corrosion protection layer and a porous ceramic layer arranged on the tight-ceramic layer. The adhesion/corrosion protection layer contains a nickel-chromium alloy and the tight-ceramic layer includes from about 50% to 100% by weight of $Al_2O_3$ and optionally comprises up to about 50% by weight of $TiO_2$. In one preferred embodiment, the thickness of the adhesion/corrosion-protection layer is from about 180 μm to about 220 μm and the thickness of the tight-ceramic layer is from about 80 μm to about 120 μm. The tight-ceramic layer may consists of from about 55% to about 65% of $Al_2O_3$ and from about 35% to about 45% of $TiO_2$. The tight-ceramic layer may further comprise an amount of $Al_2TiO_5$. The adhesion/corrosion-protection layer is applied onto the frame part by means of a high-velocity flame spraying technique and the tight-ceramic layer is applied onto the adhesion/corrosion-protection layer also by means of a high-velocity flame spraying technique.

In another embodiment of the press roll in accordance with the invention, the tight-ceramic layer includes at a minimum, an amount of $Al_2TiO_5$, and not necessarily $Al_2O_3$ and $TiO_2$. Indeed, the tight-ceramic layer may consists exclusively of $Al_2TiO_5$.

The method for manufacturing a press roll for a paper or board machine in accordance with the invention comprises the steps of forming an adhesion/corrosion-protection layer having a thickness of from about 150 μm to about 300 μm on a frame part of the roll by means of a high-velocity flame spraying technique, forming a tight-ceramic layer having a thickness of from about 50 μm to about 150 μm on the adhesion/corrosion protection layer by means of a high-velocity flame spraying technique and forming a porous ceramic layer on the tight-ceramic layer. The adhesion/corrosion protection layer contains a nickel-chromium alloy and the tight-ceramic layer includes from about 50% to 100% of $Al_2O_3$ and optionally comprises up to about 50% of $TiO_2$. In addition to or instead of the tight-ceramic layer including $Al_2O_3$ and $TiO_2$. the tight-ceramic layer may include $Al_2TiO_5$.

The coating composition for a press roll for a paper or board machine in accordance with the invention comprises a first layer adapted to be arranged directly on a core mantle of the roll, this first layer comprising an adhesion/corrosion protection layer having a thickness of from about 150 μm to about 300 μm and containing a nickel-chromium alloy, a second layer overlying the first layer and comprising a tight ceramic layer having a thickness of from about 50 μm to about 150 μm and including from about 50% to 100% of $Al_2O_3$ and optionally comprising up to about 50% of $TiO_2$, and a third layer overlying the second layer and comprising a porous ceramic layer. In addition to or instead of the tight-ceramic layer containing $Al_2O_3$ and $TiO_2$, the tight-ceramic layer may include $Al_2TiO_5$.

By means of the method in accordance with the invention, it is possible to manufacture new rolls and also to coat old rolls from which the earlier coating has first been removed.

BRIEF DESCRIPTION OF THE DRAWING

Additional objects of the invention will be apparent from the following description of the preferred embodiment thereof taken in conjunction with the accompanying non-limiting drawing, in which.

DETAILED DESCRIPTION OF THE PREFERRED EMBODIMENTS

Figure 1:
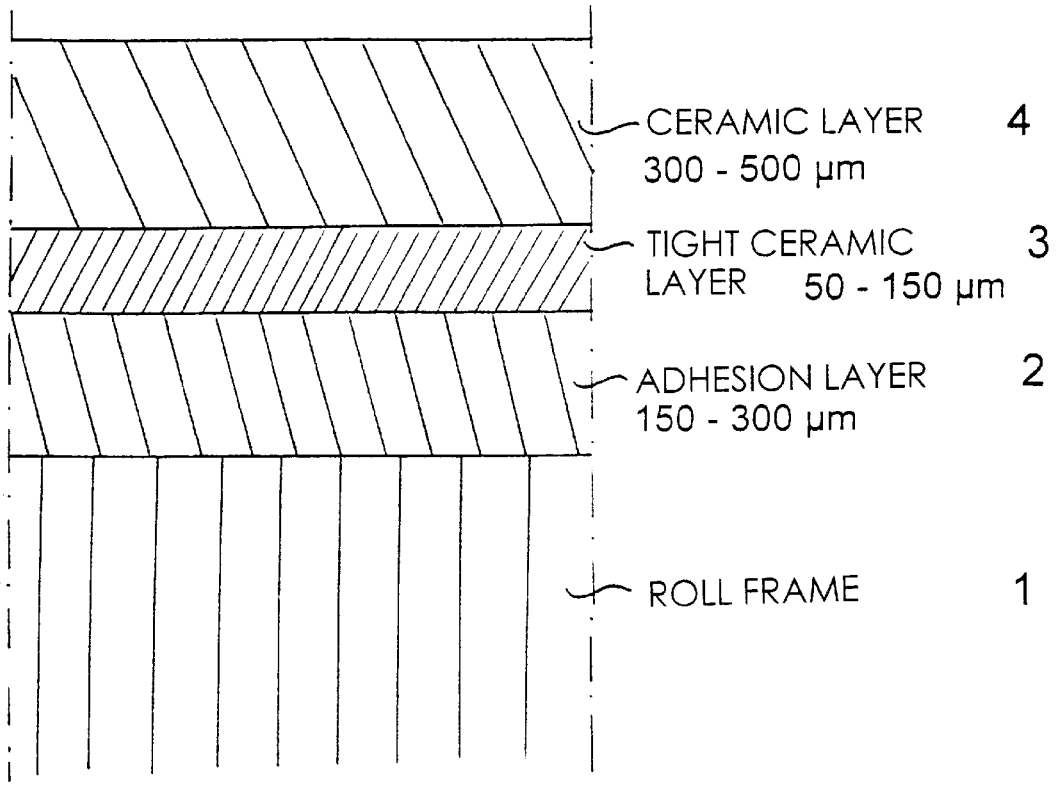
FIG. 1 is a partial cross-sectional of a coated roll in accordance with the invention, which is made by a method in accordance with the invention and includes a coating composition in accordance with the invention.

Referring to the accompanying drawing, a roll in accordance with the invention includes an outer frame part 1, which may be a mantle of the roll, a metallic adhesion/corrosion-protection layer 2 arranged on the outer surface of the frame part 1, a tight ceramic layer 3 arranged on the adhesion layer 2 and a ceramic layer 4 arranged on the tight ceramic layer 3.

In order to achieve the objects of the invention and to solve the problems occurring in the prior art, the procedure for coating a roll is as follows:

The metallic adhesion/corrosion-protection layer 2 is applied onto on the outer surface of the frame part 1 of the roll by means of a high-velocity flame spraying method (HVOF) until the metallic adhesion/corrosion protection layer 2 has a thickness from about 150 μm to about 300 μm. Then, a very tight ceramic coating layer 3 is applied onto the metallic adhesion/corrosion protection layer 2 by means of a high-velocity flame spraying technique (HVOF) until the very tight ceramic coating layer has a thickness from about 50 μm to about 150 μm. The very tight ceramic coating layer 2 is obtained by using a very finely divided coating material whose melting temperature is, owing to the mixture ratio and to the fine particle size, lower than a typical outer coating layer produced by means of plasma spraying. Thereafter, as the last layer on the frame part 1, a ceramic porous outer coating 4 is applied onto the very tight ceramic coating layer 3. In this manner, a press roll is obtained that is durable and operates well even under difficult corrosion conditions. When the HVOF method is employed, the high velocity of the coating particles (about 800 meters per second) provides the coating with an exceptionally good adhesion to the underlying substrate and with a very tight, dense structure resistant to corrosion. The coating in accordance with the invention is very well suitable for difficult corrosion conditions.

Thus, in the method in accordance with the invention, the adhesion/corrosion-protection layer 2 is applied onto the frame part 1 of the roll by means of the high-velocity flame spraying method (HVOF), which layer 2 includes a nickel-chromium alloy and has a thickness of from about 150 μm to about 300 μm, preferably from about 180 μm to about 220 μm, and then, onto this layer 2, the tight-ceramic layer 3 is applied, whose thickness is from about 50 μm to about 150 μm, preferably from about 80 μm to about 120 μm. In some embodiments, the tight-ceramic layer 3 comprises from about 50% to 100% of aluminum oxide ($Al_2O_3$) and from 0% to about 50% of titanium dioxide ($TiO_2$), preferably from about 55% to about 65% $Al_2O_3$ and from about 35% to about 45% $TiO_2$. The tight-ceramic layer 3 can also be prepared exclusively out of aluminum titanium ($Al_2TiO_5$), or $Al_2TiO_5$ can be added to the mixture of $Al_2O_3$ and $TiO_2$ in any amount, i.e., from 0% to 100%. The porous ceramic layer 4 is applied onto the tight ceramic layer 3 by means of conventional methods and is made from any desired ceramic grade.

As shown in FIG. 1, a sectional view of the roll face, the adhesion/corrosion-protection layer 2 having a thickness of from about 150 μm to about 300 μm and which contains a nickel-chromium alloy, has been applied directly onto the frame part I of the roll, i.e., in contact therewith, and onto this layer 2, the tight-ceramic layer 3 having a thickness of from about 50 μm to about 150 μm, has been applied directly, which layer 3 contains from about 50% to 100%, preferably from about 55% to about 65%, of $Al_2O_3$ and from 0% to about 50%, preferably from about 35% to about 45%, of $TiO_2$, and as the last layer, a porous outer ceramic layer 4 has been applied. The adhesion/corrosion-protection layer 2 preferably has a thickness from about 180 μm to about 220 μm and the tight-ceramic layer 3 preferably has a thickness of about 80 μm to about 120 μm.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A press roll for a paper or board machine, comprising a frame part, an adhesion/corrosion-protection layer having a thickness from about 150 μm to about 300 μm arranged on said frame part, said adhesion/corrosion-protection layer containing a nickel-chromium alloy, a tight-ceramic layer having a thickness from about 50 μm to about 150 μm arranged on said adhesion/corrosion-protection layer, said tight-ceramic layer including from about 50% to 100% of $Al_2O_3$ and optionally comprising up to about 50% of $TiO_2$, and a porous ceramic layer arranged on said tight-ceramic layer.

2. The press roll of claim 1, wherein the thickness of said adhesion/corrosion-protection layer is from about 180 μm to about 220 μm.

3. The press roll of claim 1, wherein the thickness of said tight-ceramic layer is from about 80 μm to about 120 μm.

4. The press roll of claim 1, wherein said tight-ceramic layer consists of from about 55% to about 65% of $Al_2O_3$ and from about 35% to about 45% of $TiO_2$.

5. The press roll of claim 1, wherein said tight-ceramic layer further comprises $Al_2TiO_5$.

6. The press roll of claim 1, wherein said tight-ceramic layer includes from about 50% to less than 100% of $Al_2O_3$ and up to 50% of $TiO_2$.

7. A press roll for a paper or board machine, comprising a frame part, an adhesion/corrosion-protection layer having a thickness from about 150 μm to about 300 μm arranged on said frame part, said adhesion/corrosion-protection layer containing a nickel-chromium alloy, a tight-ceramic layer having a thickness from about 50 μm to about 150 μm arranged on said adhesion/corrosion-protection layer, said tight-ceramic layer including $Al_2TiO_5$, and a porous ceramic layer arranged on said tight-ceramic layer.

8. The press roll of claim 7, wherein said tight-ceramic layer consists exclusively of $Al_2TiO_5$.

9. A coating composition for a press roll for a paper or board machine including a core mantle, comprising a first layer adapted to be arranged directly on the core mantle of the roll, said first layer comprising an adhesion/corrosion protection layer having a thickness of from about 150 μm to about 300 μm and containing a nickel-chromium alloy, a second layer overlying said first layer, said second layer comprising a tight ceramic layer having a thickness of from about 50 μm to about 150 μm and including from about 50% to 100% of $Al_2O_3$ and optionally comprising up to about 50% of $TiO_2$, and a third layer overlying said second layer, said third layer comprising a porous ceramic layer.

10. The coating composition of claim 9, wherein the thickness of said adhesion/corrosion protection layer is from about 180 μm to about 220 μm.

11. The coating composition of claim 9, wherein the thickness of said tight-ceramic layer is from about 80 μm to about 120 μm.

12. The coating composition of claim 9, wherein said tight-ceramic layer consists of from about 55% to about 65% of $Al_2O_3$ and from about 35% to about 45% of $TiO_2$.

13. The coating composition of claim 9, wherein said tight-ceramic layer includes from about 50% to less than 100% of $Al_2O_3$ and up to 50% of $TiO_2$.

14. The coating composition of claim 9, wherein said tight-ceramic layer further comprises $Al_2TiO_5$.

15. A coating composition for a press roll for a paper or board machine including a core mantle, comprising a first layer adapted to be arranged directly on the core mantle of the roll, said first layer comprising an adhesion/corrosion protection layer having a thickness of from about 150 μm to about 300 μm and containing a nickel-chromium alloy, a second layer overlying said first layer, said second layer comprising a tight ceramic layer having a thickness of from about 50 μm to about 150 μm and including $Al_2TiO_5$, and a third layer overlying said second layer, said third layer comprising a porous ceramic layer.

16. The coating composition of claim 15, wherein said tight-ceramic layer consists exclusively of $Al_2TiO_5$.

* * * * *